United States Patent [19]

Hagemeister

[11] Patent Number: 4,809,774

[45] Date of Patent: Mar. 7, 1989

[54] REVERSAL CHAMBER FOR A TUBE MATRIX OF A HEAT EXCHANGER

[75] Inventor: Klaus Hagemeister, Munich, Fed. Rep. of Germany

[73] Assignee: MTU Motoren-Und Turbinen- Union Munchen GmbH, Munich, Fed. Rep. of Germany

[21] Appl. No.: 938,581

[22] Filed: Dec. 5, 1986

[30] Foreign Application Priority Data

Dec. 12, 1985 [DE] Fed. Rep. of Germany ..... 3543893

[51] Int. Cl.[4] ..... F28D 7/06

[52] U.S. Cl. ..... 165/163; 165/176

[58] Field of Search ..... 165/163, 175, 176

[56] References Cited

U.S. PATENT DOCUMENTS

| | | | |
|---|---|---|---|
| 11,661 | 9/1854 | Carpenter | 165/176 |
| 1,782,380 | 11/1930 | Daley | 165/176 |
| 1,953,302 | 4/1934 | Johnston | 165/163 |
| 3,566,502 | 3/1971 | Pasqualini | 165/176 |
| 3,601,186 | 8/1971 | Smith et al. | 165/176 |
| 3,746,525 | 7/1973 | Kasuga et al. | 165/176 X |
| 3,808,815 | 5/1974 | Friedemann | 165/176 X |
| 4,202,405 | 5/1980 | Berg | 165/176 X |
| 4,386,652 | 6/1983 | Dragojevic | 165/176 X |

FOREIGN PATENT DOCUMENTS

| | | | |
|---|---|---|---|
| 656643 | 6/1928 | France | 165/175 |
| 2130355 | 11/1983 | United Kingdom . | |

*Primary Examiner*—Ira S. Lazarus
*Assistant Examiner*—Peggy Neils
*Attorney, Agent, or Firm*—Roberts, Spiecens & Cohen

[57] ABSTRACT

A heat exchanger having first and second ducts respectively for the supply of compressed air to be heated and for the discharge of heated compressed air. A tube matrix includes first and second branches respectively connected to the first and second ducts for conveying compressed air from the first duct to the second duct. The tube matrix is exposed to the flow of hot gases therearound to heat the compressed air conveyed in the tube matrix. A plate heat exchanger connects the first and second branches of the tube matrix to convey the compressed air from the first branch to the second. The plate heat exchanger is formed by spaced plates between which the hot gases flow, each plate being connected to rows of tubes of the matrix in the first and second branches and forming a flow chamber in which the compressed air can be conveyed.

22 Claims, 5 Drawing Sheets

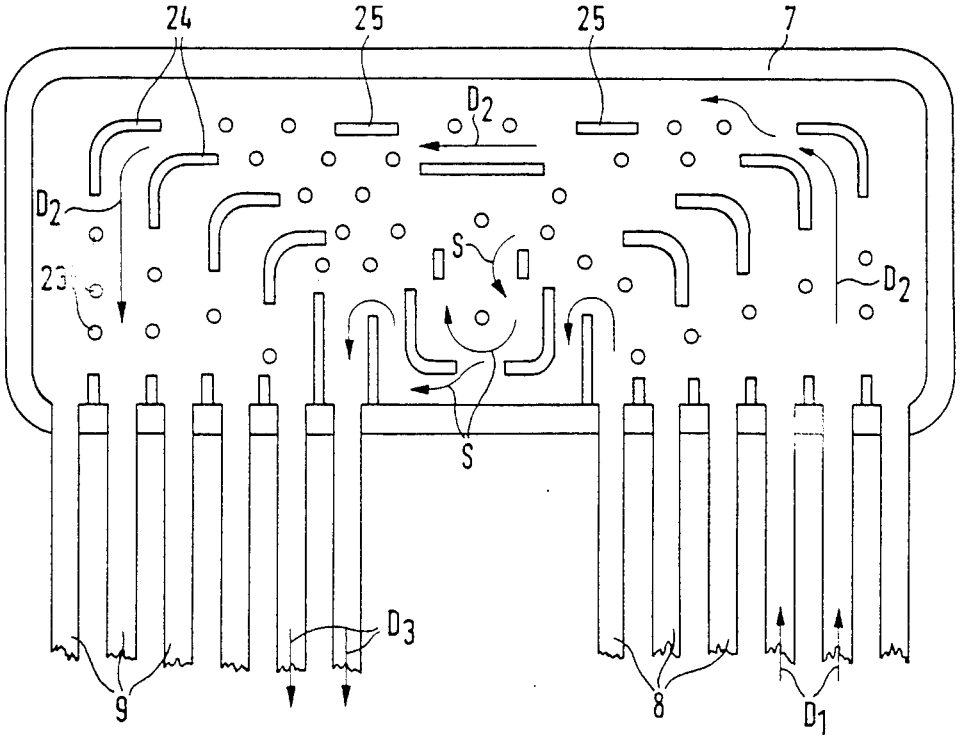
FIG. 5
FIG. 6
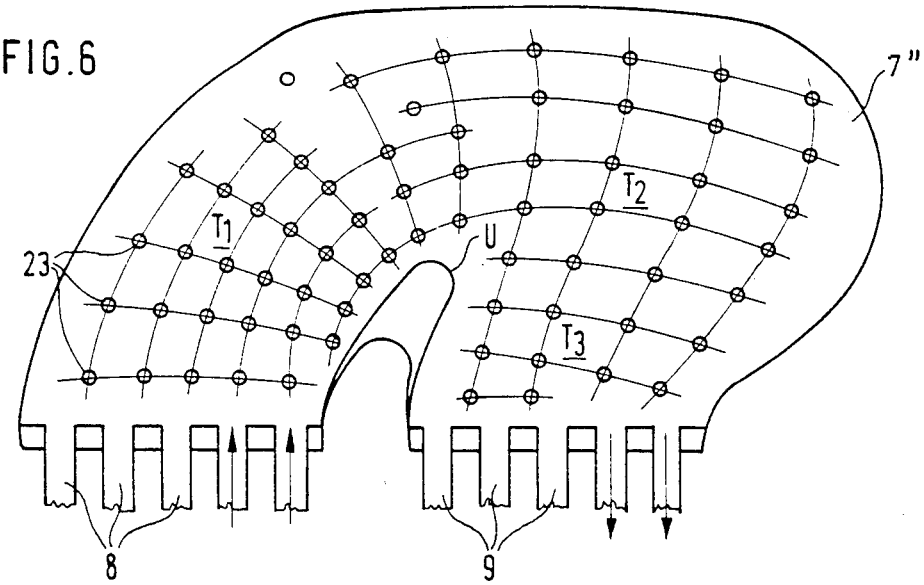

REVERSAL CHAMBER FOR A TUBE MATRIX OF A HEAT EXCHANGER

FIELD OF THE INVENTION

The invention relates to a heat exchanger comprising a tube matrix for conveying one fluid from an inlet duct to an outlet duct, the tube matrix extending into a chamber in which hot gases flow externally around the tubes of the matrix to heat the fluid flowing therein. The tubes of the matrix have straight branches connected to the ducts and U-shaped bends connected to the straight branches.

PRIOR ART

British OS No. 2,130,355 discloses a heat exchanger having a U-shaped tube matrix in which a first straight branch of the tubes of the matrix is connected to a distribution duct at right angles for receiving a fluid, such as compressed air, which is conveyed by the tube matrix through a chamber in which hot gases flow to heat the fluid in the tube matrix. The heated fluid travels through a U-shaped bend portion of the matrix where the fluid is reversed in direction and enters a second straigth branch through which the fluid travels to a second duct from which the fluid is discharged.

This construction has proven successful, particularly at high operating temperatures, since the individual U-shaped bend portions of the tubes can expand individually, substantially free of stress when heated.

This construction, however, has the following disadvantages:

The bend portions of the tubes are of different length and therefore have different flow resistance for the fluid flowing in them. As a result, the mass flow distribution is different.

In the bend or reversal region of the tubes of the matrix, the hot gases flowing externally around the tubes also encounter geometrical conditions which differ greatly locally during its travel through the tube matrix. Optimizing the flow of the hot gas is difficult and can be effected only at considerable expense. Hence, the degree of heat exchange is not optimal in the bend or reversal region of the matrix.

The bend portions of the tubes tend to vibrate in the reversal region and to eliminate the vibration, the tubes are supported by each other by complicated means.

In the straight branches of the tube matrix, each tube is assigned a given place in the flow field. The system is very sensitive in its aerodynamic and thermodynamic efficiency to deviations from these prescribed positions.

Thermal deformations as well as buckling effects due to compressive stresses along the axis of the tubes, for example, due to frictional reaction forces in the spacing systems, cause the tubes to deviate from their structurally predetermined linear length during the operation of the heat exchanger.

The bend portions of the tubes extend freely into the reversal region and are subject to impact and momentum forces without support by external members.

Since the bend portions of the tubes of different rows in the matrix have different length, the amount of their deflection under the effect of impact loads differs. The bend portions of the outer tubes are longer and thus more flexible than the bend portions of the inner tubes. As a consequence, under the effect of fluid acceleration forces, the outer tubes are deflected more than the inner ones. Since the individual tubes are secured relative to one another within the matrix field by spacers, the free deflection of the more flexible bend portions is prevented by their support on the spacers of the more rigid tubes. This means that the more rigid bend portions must also support a large part of the inertia forces of their more resilient neighboring tubes. In particular, the inner, rigid tube bend portions must thereby support the sum of the loads in preventing the deflection of all of the tube bend portions outward thereof.

SUMMARY OF THE INVENTION

An object of the present invention is to eliminate the above-mentioned disadvantages of the prior art construction and to provide a heat exchanger which, in particular with respect to the critical bend or reversal region of the tube matrix, achieves a comparatively high degree of heat exchange and at the same time a functionally proper mounting and support of the tubes at the bend or reversal region.

This object is achieved according to the invention by replacing the U-shaped bend portions of the tubes of the conventional tube matrix with a plate heat exchanger which connects directly to the straight branches of the tubes of the matrix and conveys the fluid from the branch which introduces the fluid into the plate heat exchanger to the branch which conveys the fluid away from the plate heat exchanger.

In accordance with the invention, the plate heat exchanger defines chambers in which the fluid undergoes mixing and heat exchange in its travel from the incoming branch to the outgoing branch.

This construction has a number of advantages as compared to the conventional use of bend regions in the tubes of the matrix, and some of these are expressed hereafter.

1. The profiled tubes of the heat exchanger are accurately positioned with respect to each other in a fixed structural relation not only at their ends secured to the inlet duct but also at their remote ends. The location of each individual profiled tube at its assigned place in the field of flow of the hot gases can thus be accurately maintained, even under the action of thermal deformation.

2. A group of plate-shaped chambers arranged in rows or layers one alongside the other can be supported in an adjoining holding device so that the profiled tubes remain substantially free of load from acceleration and momentum forces which would normally produce impact forces and vibration, particularly in the flexible outer tubes of the conventional bend portions of the U-shaped tubes.

3. Vibrations of individual profiled tubes of the matrix produce disturbances in the heat exchange and can lead to fatigue failure and this is avoided by the rigid support of the profiled tubes by the plate chambers and which in turn, are securely supported by a rigid surrounding structure.

4. The exterior surfaces of the plate chambers can be formed and shaped so that the hot gases flowing around the outside of the tubes and the plate chambers is optimally guided to prevent short-circuiting of heat exchange in the plate heat exchanger.

5. The number of inlet tubes in a row can differ from that of the outlet tubes. This can be of importance for the thermodynamic optimization of the heat exchanger. In this way, for example, different flow velocities of the compressed air in the inlet and outlet tubes can be obtained.

6. Different materials can be used for the inlet and outlet tubes of the tube matrix.

As a further development, the plate shaped chambers can each be formed of two plates which sealingly receive the ends of the tubes of one row of the matrix, the peripheral edges of the plates being securely and sealingly connected together.

For reinforcement and support against the effects of the internal pressure, the two plates of each chamber can, in accordance with a further development of the invention, be connected to each other at discrete places by spacers and, in this way, the spacing necessary to establish the flow cross section can also be obtained. The spacers can, be shaped so that they influence the internal flow of the conveyed fluid (compressed air) not only to effect flow reversal but also to optimize the heat transfer conditions.

The plates need not be planar but can be provided with undulations and corrugations on their surfaces to compensate for thermal deformations and distortions. Additionally the undulations and corrugations can also be developed to improve the heat transfer. In order to maintain narrow chamber spacings between the two plates in each case as well as between adjacent pairs of plates for different rows of tubes, it is furthermore contemplated, within the scope of the invention, to have the undulations and corrugations be correlated with one another. It is to be appreciated that the external hot gases flow between the pairs of adjacent plates and are influenced by the undulations and corrugations.

BRIEF DESCRIPTION OF THE FIGURES OF THE DRAWINGS

FIG. 5 is an interior view of one half of a complete reversal chamber in which spacer elements, reversal means and aerodynamic baffles are shown.

FIG. 6 is an inner view of a modified arrangement of the reversal chamber in FIG. 5 wherein the chamber is eccentrically curved or bulged to achieve aerodynamically optimized low-loss reversal in combination with a suitable arrangement of pin-like spacer elements.

DETAILED DESCRIPTION OF A PREFERRED EMBODIMENT

Figure 1:
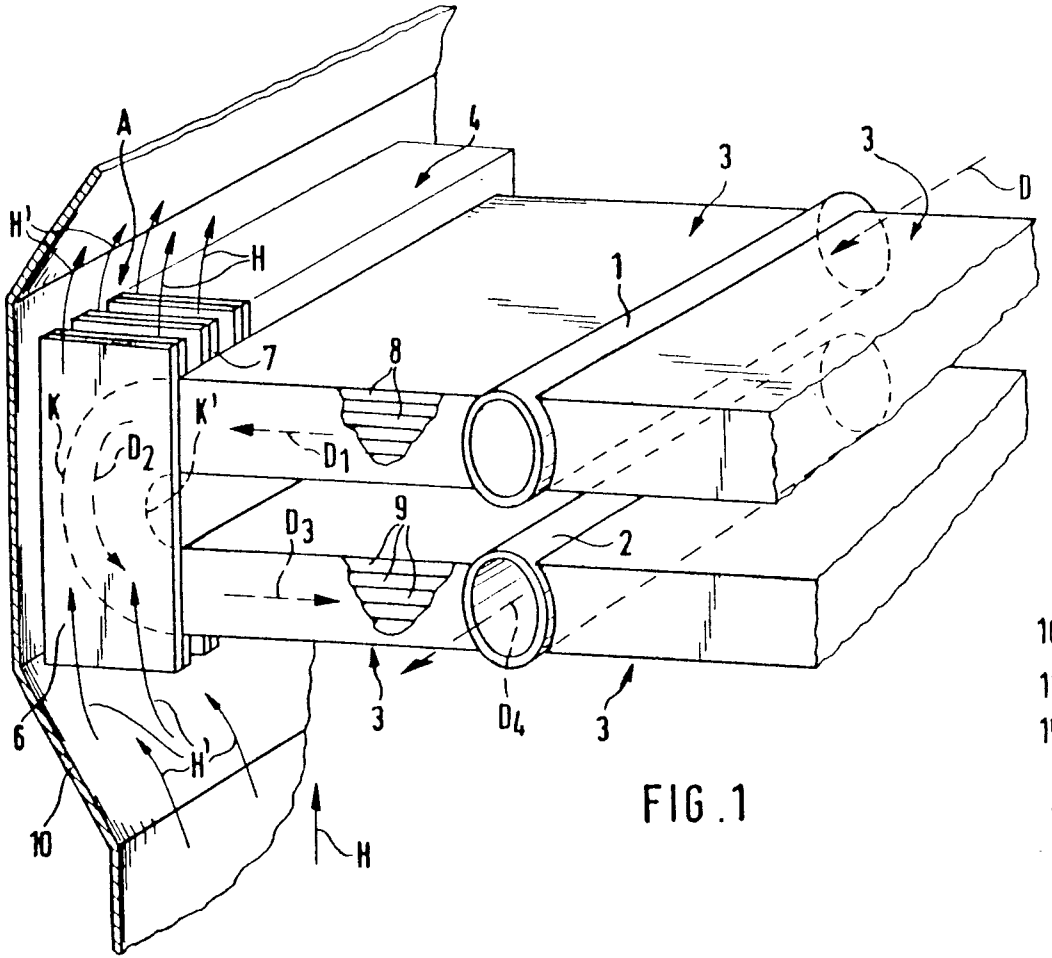
FIG. 1 is a diagrammatic, perspective view, partially broken away and in section, of a portion of one embodiment of a heat exchanger according to the invention.
Figure 10:
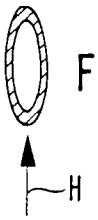
FIG. 10 is a transverse cross section of a tube of the matrix.

FIG. 1 shows a heat exchanger which operates according to counterflow of two fluids which exchange heat. The heat exchanger comprises two parallel ducts 1,2 arranged one above the other. Extending laterally at each side of the ducts 1, 2, is a tube matrix 3 composed of upper rows of straight branches 8 of profiled tubes of elongate cross-section and lower rows of straight branches 9 of the profiled tubes. The cross-sectional profile of the tube is shown in FIG. 10 and therefrom it is seen that the tube has an oval cross-section. In each of the straight branches 8 and 9, the rows of the tubes are oriented vertically and in each row the tubes extend in parallel spaced relation. In FIG. 1 the branches 8, 9 are diagrammatically shown in outline form to give some idea of the length and width but it is to be understood that the branches are composed of rectilinear lengths of profiled tubes arranged in the matrix. The branches 8 and 9 of the tube matrixes are located in the path of flow of hot gases H and the hot gases flow around the profiled tubes to heat a fluid flowing in the tubes. At the ends of the branches 8 and 9 remote from ducts 1, 2, the matrixes 3 are connected to a reversal section 4 in which the fluid flowing from branch 8 is reversed in direction and flows to branch 9. The reversal section 4 is constituted as a plate heat exchanger and comprises juxtaposed pairs of plates 6, 7 which enclose reversal chambers 5 therebetween in which the fluid from the tubes of branch 8 can flow to the tubes of branch 9.

As appears more clearly in detail, for instance, in FIGS. 1 to 5, the plates 6, 7 of the reversal section 4 are securely attached in fluid-tight manner to each other along their outer edges. The tubes in the rows in branches 8, 9 of the matrix 3 convey the fluid therein, such as compressed air, in respective opposite directions $D_1$, $D_3$ and the tubes of branches 8, 9 are connected to the plates 6, 7 respectively at inlet and outlet sides thereof.

In operation, compressed air D which is to be heated in the heat exchanger enters at one end of duct 1 and is fed therefrom to the upper branch 8 in the direction $D_1$ and the compressed air is then reversed along path $D_2$ in the reversal chambers 5 contained in the reversal section 4 so that the compressed air now flows in the opposite direction $D_3$ through the lower branch 9 and then in heated state, into the lower duct 2 from which the heated compressed air is discharged at $D_4$ to a utilization means, such as the combustion chamber of a gas turbine engine.

In accordance with FIG. 1, the matrix reversal section 4 extends adjacent to a lateral wall 10 of a housing of the heat exchanger through which the hot gases flow along paths H, H'. The gases which flow along path H' travel on the outer surfaces of plates 6, 7. As a result of the juxtaposed, spaced arrangement of the pairs of plates 6,7 gaps or spaces A are formed which are shown relatively large in size in FIG. 1 in order to make the construction clear. As shown in FIG. 1, the plates 6, 7 of the heat exchanger are arranged one after the other in planes perpendicular to the axes of the ducts 1, 2.

The entire reversal section 4 of the matrix 3 participate in a homogeneous heat exchange process at the heat exchange surfaces. The dotted outlines K, K' in FIG. 1 represent the conventional U-shaped bend region of individual tubes as customary in the prior art. The reversal section 4 replaces the conventional bend regions of the tubes.

In FIG. 1 the tube matrix 3 extending to the right, which is broken away, is connected to a respective reversal section (not shown) in the same manner as shown at the left. However, it is also possible for only one matrix 3 to extend at one side from the ducts 1, 2 and be connected to a single reversal section 4.

Furthermore, it is possible, to integrate both ducts as tubular elements separated from each other in a common manifold as known in the art.

Figure 2:
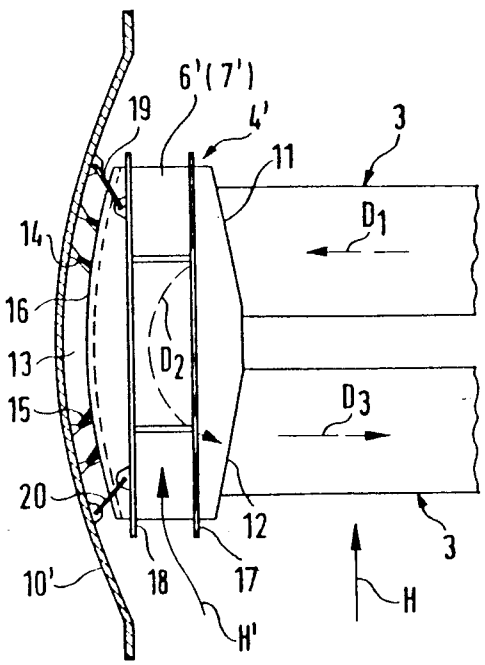
FIG. 2 is a side, elevation view partially broken away and in section of a portion of another embodiment of a heat exchanger.

As seen in FIG. 2, the plates 6' 7' which form the reversal chambers 5 have beveled end surfaces 11, 12 at the inlet and outlet sides of the matrix 3. The adjoining housing wall 10' is curved outwards in correspondence with the rounded contour of the outer surface of the reversal section 4'. In order to seal off a leakage gap 13 for the hot gases between housing wall 10' and reversal section 4', brush seals 14, 15 are mounted on wall 10' and compensate for relative movement between the wall 10' and the reversal section 4'. The bristles of the brush seals 14, 15 rest snugly at all times in sealing contact with corresponding end surfaces of the reversal section to seal leakage gap 13. The bristles can bear against a guide wall 16 connected to the reversal section 4' or they can bear directly against plates 6' 7'.

The individual plates 6' 7' are secured together and are spaced from the juxtaposed secured plates by a frame construction consisting of members 17, 18 to form the gaps A. The frame construction, in turn, is suspended from the wall 10' by means of end articulation linkages 19, 20 to compensate for relative movement between the wall and the reversal section.

Figures 3, 4:
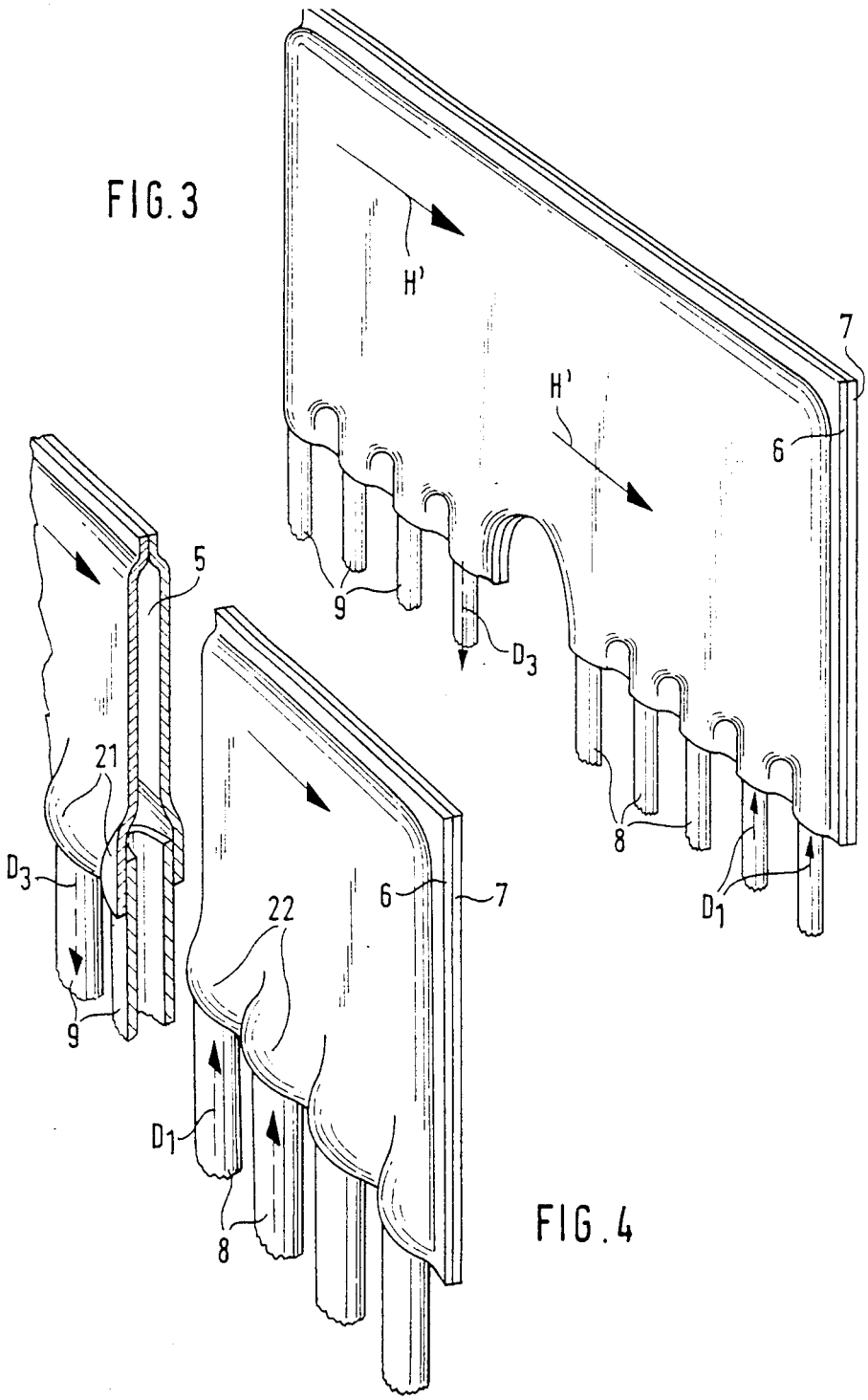
FIG. 3 is a perspective view of an embodiment of a reversal chamber formed by two plates and having a substantially smooth external surface, the tubes of the matrix extending laterally into the chamber.
FIG. 4 is a partially broken away view of a reversal chamber which has been cut open transversely in order to show local engagement with the profiled tubes of the matrix.

From FIGS. 3 and 4 it can be seen that each pair of plates 6, 7 cooperates with a row of the tubes of the branches 8, 9 to effect reversal of fluid flow from $D_1$ to $D_3$. The hot gas flow H' is also seen in FIGS. 3 and 4.

As particularly evident from the cut away portion of the reversal section in FIG. 4, local bulges 21, 22 in the plates tightly receive the rows of profiled tubes of branches 8 and 9 of the matrix 3 for input and discharge of the compressed air into and from reversal chamber 5.

In FIG. 3 it can be seen that the number of tubes of one row 8 can be greater than the number of tubes of the other row 9.

Using the same reference numbers for substantially the same elements, FIG. 5 shows a reversal chamber configuration in which spacer members, such as pins 23, curved reversal plates 24 and straight guide elements 25, are provided at discrete locations between two adjacent plates 6, 7. The spacer members, which serve as reversal aids, define the flow cross section in chamber 5. The arrangement and shape of the pins, plates and guide elements is to produce a smooth reversal of the flow of compressed air along path $D_2$ while also creating local eddies or uniform recirculation zones (arrows S) at given locations to increase the residence time of the compressed air locally to effect a high degree of heat exchange. The arrows S indicate "critical" reversal zones between the two rows of tubes 8, 9. Without the plates or pins, a relatively pronounced separation zone would be produced.

FIG. 6, shows an embodiment of plate 7'' to achieve a total reversal of flow which is as homogeneous as possible especially avoiding a pronounced separation zone in the critical inner reversal region, in the reversal chamber between the two rows of tubes 8, 9. This is effected by the contouring of plate 7'' and thereby of the reversal chamber according to the locally distributed arrangement of spacer pins 23, in the illustrated pattern of flow and potential lines. The reversal chamber has, as seen from left to right, first of all a substantially continuously inwardly curved portion (chamber region $T_1$). Downstream of an inner reversal zone U, the reversal chamber then widens to a laterally bulged chamber section of larger cross section (chamber region $T_2$). From the bulged chamber region $T_2$, the reversal chamber then tapers again to a chamber region $T_3$ of decreased cross setion which is adapted at the end adjoining the row of tubes 9, essentially to the corresponding entrance cross section at the row of tubes 8 at region $T_1$.

The invention is not limited to an arrangement in which all reversal means or guide plates or aerodynamic baffles are constructed as spacers which maintain the spacing between adjacent plates 6, 7. Shaped bodies or plate embossings which are applied on one or both plates 6, 7 and merely protrude partially into the reversal chamber can be provided both as aerodynamic baffles for increasing the degree of heat exchange and as reversal aids.

The plates 6, 7 forming the reversal chambers 5 can be provided on the surfaces facing the hot gases and/or the compressed air with contouring which compensates thermal deformations and/or increases the degree of heat exchange.

Figure 7:
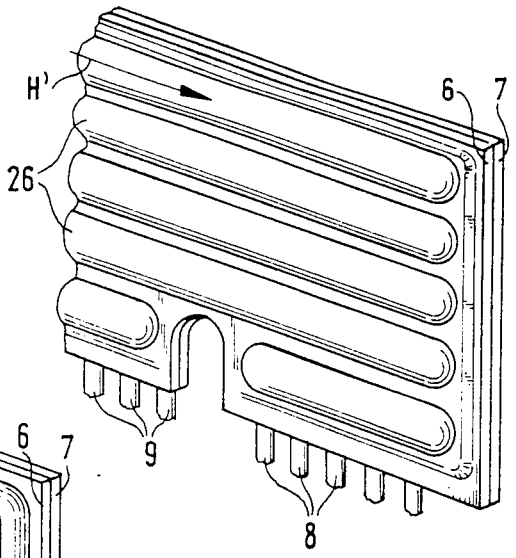
FIG. 7 is a perspective view of a reversal chamber formed by two plates which is modified as compared to FIGS. 3 and 4 and has corrugations extending in the longitudinal direction of the plates.
Figure 8:
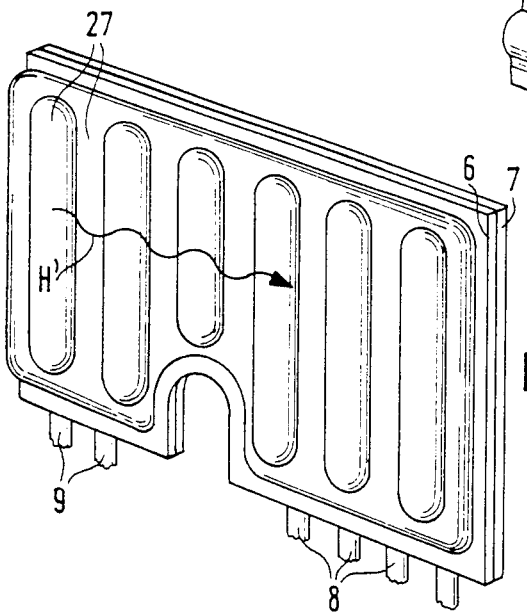
FIG. 8 is an embodiment of a plate reversal chamber which is modified as compared to FIG. 7 in that local corrugations extend in the transverse direction.

Such contouring can be corrugations or undulations on the corresponding surface facing the hot gases and the compressed air sides as seen in FIGS. 7 and 8. In FIG. 7 corrugatious 26 extend in the directions of the hot gas flow H' while in FIG. 8 the corrugations 27 extend transversely of the direction of flow H' of the hot gases.

In one suitable embodiment, the spacer elements which maintain the spacing of the walls of the reversal chamber (for example, chamber 5 in FIG. 4) as well as the plate gap A (FIG. 1) can be formed, in part, on opposite walls in correlation with each other.

The invention contemplates the possibility of combining corrugated configurations as shown in FIGS. 7 or 8 with the spacer members in the reversal chamber in FIG. 5, or providing the corrugations in FIGS. 7 and 8 in alternating sequence in the matrix reversal section 4.

Figure 9:
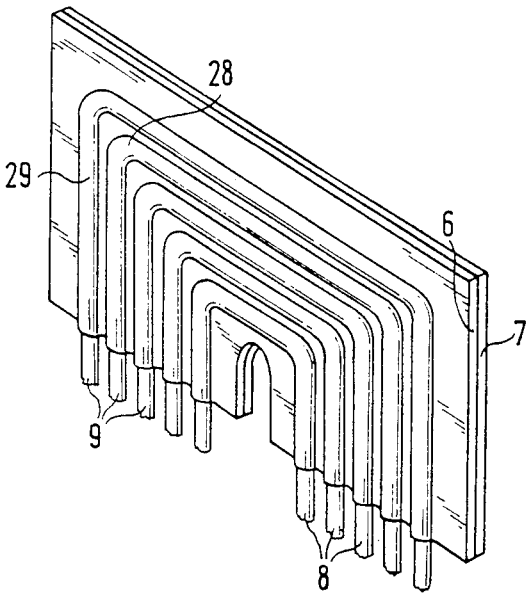
FIG. 9 is a perspective view of another embodiment of a plate reversal chamber, which is modified as compared with all previous embodiments primarily by the provision of a number of individual reversal channels corresponding to the number of entering ends of the tubes of the matrix.

FIG. 9 shows a reversal section 4 in which a plurality of separated channel-shaped reversal chambers are defined between plates 6, 7 of the reversal section. The number of channel-shaped reversal chambers is adapted to the number of tubes in rows 8 and 9 respectively which connect to the reversal section. In FIG. 9, the channel-shaped reversal chambers are formed between opposed portions 28, 29 in the two adjacent plates 6, 7.

The invention also contemplates the concept of providing channel-shaped reversal chambers which are fluidly separated from each other and having, for instance, two tubes of a row 8 or 9 respectively connected into each reversal chamber.

Depending on requirements, the channel-shaped reversal chambers may, in part, fluidly communicate with each other.

In the cross sectional view in FIG. 10, the tube profile is oval as previously explained and provides optimized profile tapering in streamlined manner at the leading and trailing edges relative to the direction of flow H of the hot gases in the rows 8 and 9 respectively of the matrix 3.

Figure 11:
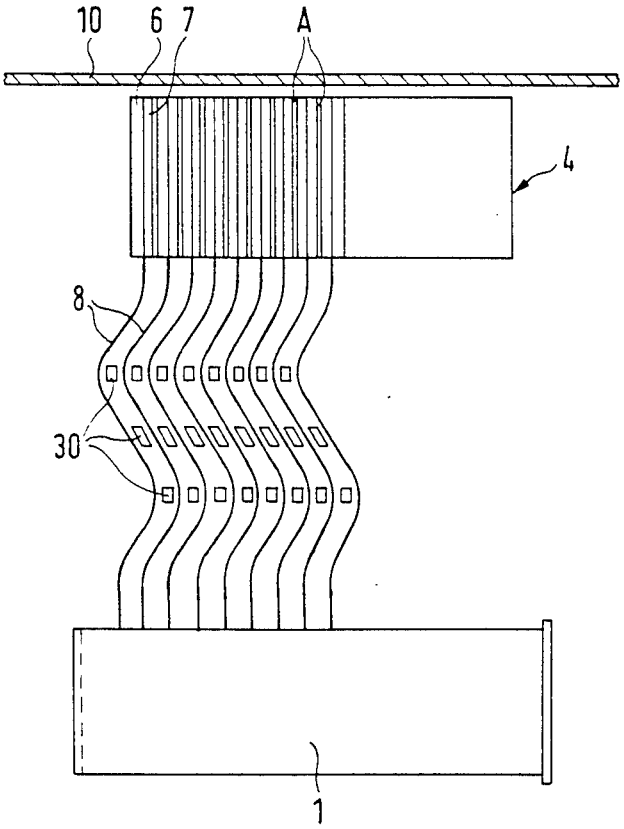
FIG. 11 is a top view of the heat exchanger with periodically curved tubes.

FIG. 11 shows another variant of the invention in which the profiled tubes in the rows, e.g. rows 8 in FIG. 11, are curved in the direction of their longitudinal axes between the ducts 1 and the reversal section 4. Spacers 30 are placed between the profiled tubes in the rows.

As a result of the curved shape of the tubes which periodically undulate on both sides of the longitudinal axis, the tube is capable of deforming with only slight resistance to displacement forces.

Disturbances in the longitudinal spacing of the tube ends (for example, by thermal expansion of the tube relative to the supports, or by displacements of the supports with respect to each other in the direction of the tube axis) are taken up and compensated by bending of the profiled tube, and predetermined by the shape of the curve. Depending on the magnitude of the lateral protrusion of the curved tube, the transverse displacements of the profiled tube under the action of changes in length (for example, as a result of thermal expansion) are several orders of magnitude smaller than the corresponding transverse deflection of a linear tube.

Transverse displacements of the tube ends in the plane of the curve are compensated by bending of the tubes.

In the case of displacements perpendicular thereto, a linear oval tube is bent around its transverse axis (about which the tube has its maximum moment of inertia) and consequently the tube develops correspondingly large reaction forces. In contradistinction to this, the profiled tube of FIG. 11 of periodic curved shape along its longitudinal axis reacts with small torsional deformations.

Due to the locally different conditions of heat transfer in the direction of the outer flow along the cross section of the oval tube, the leading edge of the tube is at a higher temperature than the trailing edge. The difference in thermal longitudinal expansion of the oval tube caused thereby would, in the case of a linear to be, cause the tube to bend in the direction towards the hotter side. This bending can be considerable and displace the oval tube out of its assigned position in the field of flow so that reduction in the efficiency of the heat exchanger and possibly also increased pressure losses would occur.

In such a case, the oval tube of curved shape according to the invention is forced substantially less out of its position. While the leading and trailing edges also experience different thermal expansions, the tube accommodates this by twisting in its cross-section and the profiled tube remains substantially in the plane of its curvature and does not bend in the direction of the portion of higher temperature.

Although the invention has been described in relation to specific embodiments of the invention, it will become apparent to those skilled in the art that numerous modifications and variations can be made within the spirit and scope of the invention as defined by the attached claims.

What is claimed is:

1. A heat exchanger comprising first and second ducts one for supply of compressed air to be heated and the other for discharge of heated compressed air, a tube matrix forming first and second branches with inner and outer tube ends, the inner tube ends of said first and second branches being respectively connected to said first and second ducts for conveying compressed air from said one duct to said other duct, said branches of the tube matrix projecting transversely to a flow of hot gases therearound which heats the compressed air conveyed therein, and a plate heat exchanger exposed to the flow of hot gases, said plate heat exchanger including a row of juxtaposed spaced pairs of plates defining gaps therebetween for flow of the hot gases through said gaps, each of said spaced pairs of plates cooperatively defining therebetween a reverse flow chamber means for the compressed air, said pairs of plates being respectively connected to said outer ends of said first and second branches of said tube matrix for heating said compressed air in said flow chamber means by the hot gases flowing through said gaps during reversal of flow of said compressed air from said first to said second branch of said tube matrix.

2. A heat exchanger as claimed in claim 1 wherein the tubes in said branches are arranged in rows extending transversely from the ducts, each pair of plates being connected to the respective outer ends of the first and second branches of respective rows.

3. A heat exchanger as claimed in claim 1 comprising means facing said row of juxtaposed spaced pairs of plates for cooperating therewith to guide the flow of hot gases to said plates and through said gaps between the spaced pairs thereof.

4. A heat exchanger as claimed in claim 1 wherein said plates are substantially flat and in each pair are connected in abutting face to face sealed relation with one another and with said outer ends of said first and second branches.

5. A heat exchanger as claimed in claim 1 wherein said pairs of plate members each defines chambers into which the compressed air flows from one branch and from which the compressed air flows to the other branch.

6. A heat exchanger as claimed in claim 5 wherein said chambers are shaped so that the compressed air travels along a reversal path to reverse its direction of flow in said chambers.

7. A heat exchanger as claimed in claim 6 wherein each pair of plates is connected together in fluid-tight, sealed manner and defines at least one said chamber, one row of tubes in each branch being connected to each pair of plates.

8. A heat exchanger as claimed in claim 7 comprising spacer members in said chambers between the plates of each pair, said spacer members being shaped to cause the compressed air to flow along said reversal path and to define the cross-section of said chamber.

9. A heat exchanger as claimed in claim 8 wherein said spacer members are on at least one of said plates on the inner wall thereof and are aerodynamically shaped to increase the heat exchange with the hot gases.

10. A heat exchanger as claimed in claim 7 wherein said plates have contoured walls.

11. A heat exchanger as claimed in claim 10 wherein said contoured walls are undulated.

12. A heat exchanger as claimed in claim 10 wherein the contoured walls of the respective pairs of plates hold said plates apart to define the chamber therein while the walls of adjacent pairs of plates establish gaps therebetween for flow of heated gases.

13. A heat exchanger as claimed in claim 7 wherein each said pair of plates defines shaped connections which correspond to the cross-sectional shape of the tubes of the branches of the matrix to snugly receive said tubes in fluid-tight manner.

14. A heat exchanger as claimed in claim 13 wherein said connections for said tubes are formed in part in each plate of a respective pair.

15. A heat exchanger as claimed in claim 7 wherein a plurality of said chambers are formed by each said pair of plates and are at least partially fluidly separated from one another.

16. A heat exchanger as claimed in claim 15 wherein said plurality of chambers is equal in number to the number of tubes in the rows of each branch.

17. A heat exchanger as claimed in claim 16 wherein said chambers are of channel shape which is formed in part by each plate of the associated pair of plates of the plate heat exchanger.

18. A heat exchanger as claimed in claim 1 wherein the tubes in said branches are of oval shape cross section with streamlined leading and trailing edges facing in the direction of flow of the hot gases.

19. A heat exchanger as claimed in claim 1 wherein the tubes in said first and second branches have an undulating curvature between said ducts and said plate heat exchanger.

20. A heat exchanger as claimed in claim 1 wherein said branches extend parallel to one another.

21. A heat exchanger as claimed in claim 20 wherein the number of tubes in the row of one branch is different from the number of tubes in the row of the other branch.

22. A heat exchanger as claimed in claim 8 wherein said spacer members establish the cross-section of said chambers to be curved in arcuate shape from the tubes of one branch to the tubes of the other branch such that each chamber widens from an initially substantially continuously curved inlet chamber portion downstream of an inner reversal arch portion to a laterally bulged chamber portion of greater cross-section and then to an inwardly constricted outlet chamber portion whose cross-section is substantially the same as the cross-section of said inlet chamber.

* * * * *